US009434201B2

(12) United States Patent
Dannhauser et al.

(10) Patent No.: US 9,434,201 B2
(45) **Date of Patent: *Sep. 6, 2016**

(54) INKJET RECORDING MEDIUM AND METHODS THEREFOR

(75) Inventors: Thomas J. Dannhauser, Pittsford, NY (US); Gerald A. Campbell, Webster, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 1497 days.

This patent is subject to a terminal disclaimer.

(21) Appl. No.: 12/781,265

(22) Filed: May 17, 2010

(65) Prior Publication Data

US 2011/0279554 A1 Nov. 17, 2011

(51) Int. Cl.

| | |
|---|---|
| ***B41M 5/52*** | (2006.01) |
| ***D21H 19/44*** | (2006.01) |
| ***D21H 19/64*** | (2006.01) |
| *B41M 5/50* | (2006.01) |
| *D21H 19/42* | (2006.01) |
| *D21H 19/56* | (2006.01) |
| *D21H 19/60* | (2006.01) |
| *D21H 21/14* | (2006.01) |

(52) U.S. Cl.

CPC ..... *B41M 5/52* (2013.01); *D21H 19/44* (2013.01); *D21H 19/64* (2013.01); *B41M 5/50* (2013.01); *B41M 5/5218* (2013.01); *D21H 19/42* (2013.01); *D21H 19/56* (2013.01); *D21H 19/60* (2013.01); *D21H 21/14* (2013.01)

(58) Field of Classification Search

None

See application file for complete search history.

(56) References Cited

U.S. PATENT DOCUMENTS

| | | | | |
|---|---|---|---|---|
| 4,513,301 | A | 4/1985 | Takayama et al. | |
| 4,554,181 | A | 11/1985 | Cousin et al. | |
| 6,066,387 | A * | 5/2000 | Ueda | B41M 5/5236 428/32.27 |
| 6,206,517 | B1 | 3/2001 | Kovacs et al. | |
| 6,207,258 | B1 | 3/2001 | Varnell | |
| 6,238,047 | B1 | 5/2001 | Suzuki et al. | |
| 6,350,507 | B1 * | 2/2002 | Iwamoto | B41M 5/5218 428/32.33 |
| 7,037,973 | B2 | 5/2006 | Botros et al. | |
| 7,091,276 | B2 | 8/2006 | Botros | |
| 7,199,182 | B2 | 4/2007 | Tanaka et al. | |
| 7,569,255 | B2 * | 8/2009 | Dannhauser et al. | 427/407.1 |
| 2003/0103129 | A1 | 6/2003 | Tanaka et al. | |
| 2003/0157276 | A1 | 8/2003 | Romano, Jr. | |
| 2004/0035325 | A1 | 2/2004 | Botros et al. | |
| 2004/0241351 | A1 | 12/2004 | Sharmin et al. | |
| 2004/0255820 | A1 | 12/2004 | Chen et al. | |
| 2008/0090949 | A1 | 4/2008 | Nagao et al. | |

FOREIGN PATENT DOCUMENTS

| | | |
|---|---|---|
| JP | 2003-335043 | 11/2003 |
| JP | 2004-122556 | 4/2004 |

* cited by examiner

*Primary Examiner* — An Do
*Assistant Examiner* — Renee I Wilson
(74) *Attorney, Agent, or Firm* — Andrew J. Anderson; Raymond L. Owens; J. Lanny Tucker

(57) ABSTRACT

An inkjet receiving medium including a substrate and having a topmost layer coated thereon at solid content of from 0.1 to 25 g/m$^2$, wherein the topmost layer comprises from 30-70 wt % of one or more aqueous soluble salts of multivalent metal cations and at least 0.05 g/m$^2$ of a cross-linked hydrophilic polymer binder. Improved optical density, reduced mottle and improved wet abrasion resistance are provided when the receiver is printed with an aqueous pigment-based ink. In further embodiments, the topmost layer may further comprise a latex dispersion for improved image durability.

17 Claims, No Drawings

INKJET RECORDING MEDIUM AND METHODS THEREFOR

FIELD OF THE INVENTION

The invention relates generally to the field of inkjet, and in particular to inkjet recording media, a printing system, and to a printing method using such media. More specifically, the invention relates to inkjet recording media ranging from a water resistant to a highly water-absorbent substrate and an image-enhancing surface treatment or layer.

BACKGROUND OF THE INVENTION

The present invention is directed in part to overcoming the problem of printing on glossy or semi-glossy coated papers or the like with aqueous inkjet inks. Currently available coated papers of this kind have been engineered over the years to be compatible with conventional, analog printing technologies, such as offset lithography, and may be designated as "offset papers." The printing inks used in offset printing processes are typically very high solids, and the solvents are typically non-aqueous. As a consequence, the coatings that are currently used to produce glossy and semi-glossy offset printing papers, such as those used for magazines and mail order catalogs, have been intentionally designed to be resistant to the absorption of water. In fact, when these papers are characterized by standard tests as to their porosity and/or permeability, they have been found to be much less permeable than a typical uncoated paper.

In contrast to lithographic inks, inkjet inks are characterized by low viscosity, low solids, and aqueous solvent. When such coated offset papers are printed with inkjet inks that comprise as much as 90-95% water as the carrier solvent, the inks have a tendency to sit on the surface of the coating, rather than penetrate into the coating and/or underlying paper substrate.

Because the inks printed on a water-resistant receiver must dry primarily by evaporation of the water without any significant penetration or absorption of the water into the coating or paper, a number of problems are encountered. One such problem is that the individual ink droplets slowly spread laterally across the surface of the coating, eventually touching and coalescing with adjacent ink droplets. This gives rise to a visual image quality artifact known as "coalescence" or "puddling." Another problem encountered when inks dry too slowly is that when two different color inks are printed next to each other, such as when black text is highlighted or surrounded by yellow ink, the two colors tend to bleed into one another, resulting in a defect known as "intercolor bleed." Yet another problem is that when printing at high speed, either in a sheet fed printing process, or in a roll-to-roll printing process, the printed image is not dried sufficiently before the printed image comes in contact with an unprinted surface, and ink is transferred from the printed area to the unprinted surface, resulting in "ink retransfer."

In contrast to glossy offset papers, some coated papers for offset lithography have matte surfaces that are very porous. While high-solids lithographic inks remain on the surface, the colorant of aqueous inkjet inks on the other hand tends to absorb deeply into the paper, resulting in a substantial loss of optical density and as a consequence, reduced color gamut.

Recently high speed continuous inkjet printing processes have been developed that are suitable for high speed, mid-volume printing and have become of interest to the commercial printing industry. As commercial offset papers are manufactured in high volume, it would be preferable to be able to use such offset papers themselves for commercial inkjet printing purposes, to take advantage of economies of scale. For the several reasons discussed above, however, the standard preparation of substrates for offset lithographic printing renders them unsuitable for printing with aqueous inkjet inks. Thus the need arises for inkjet-printable receivers providing the familiar look and feel as well as economical cost of standard lithographic printing-grade offset papers.

The requirements of commercial printing industry include, among others, image quality in terms of high optical density, broad color gamut, sharp detail, and minimal problems with coalescence, smearing, feathering and the like. Operationally, the printing process strives for low environmental impact, low energy consumption, fast drying, and so forth. The resulting print must exhibit durability, resisting abrasion when dry or if wetted.

Simply omitting the water-resistant coating of a glossy lithographic offset paper does not enable high-quality inkjet printing. Uncoated paper does not maintain the ink colorant at the surface, but allows significant penetration of the colorant into the interior of the paper, resulting in a loss of optical density and a low-quality image. Moreover, ink penetrates non-uniformly into the paper due to the heterogeneous nature of the paper, giving rise to mottle, which further degrades the image.

Very high quality photopapers have been developed for desktop consumer inkjet printing systems incorporating relatively high laydown ink-receiving layers that are porous and/or permeable to the ink. However, such coated photopapers are generally not suitable for high-speed commercial inkjet printing applications for a number of reasons. The thick coatings result in a basis weight that is impractically heavy for mailing or other bulk distribution means. Such receivers are not meant for rough handling or folding, which would result in cracking of the coated layers. In general, these coated photopapers are too expensive for high-speed inkjet commercial printing applications, such as magazines, brochures, catalogs, and the like. This is because such coated photopapers require either expensive materials, such as fumed oxides of silica or alumina, to produce a glossy surface or very thick coatings to adequately absorb the relatively heavy ink coverage required to print high quality photographs.

Multivalent metal salts are known to improve the print density and uniformity of images formed on plain papers from inkjet printers. For example, Cousin, et al., in U.S. Pat. No. 4,554,181, disclose the combination of a water-soluble salt of a polyvalent metal ion and a cationic polymer at a combined dry coat weight of 0.1 to 15.0 g/m$^2$, for improving the print density of images printed by inkjet printers employing anionic dye-based inks. Low coating coverages in layers comprising a cross-linked hydrophilic polymer are not disclosed.

Varnell, in U.S. Pat. No. 6,207,258, discloses the use of water-soluble salts of multivalent metal ions combined with a polymeric sizing agent and a carrier agent in a size press to improve the print density and uniformity of images formed on plain papers from inkjet printers employing pigment colorants in the ink set. The actual surface concentrations are not readily apparent from the disclosure of the size-press application method.

Takayama, et al., in U.S. Pat. No. 4,513,301 disclose a heat sensitive recording material comprising a binder of acetoacetylated PVA at 2 to 12 g/m$^2$, but do not suggest its use as an inkjet receiver. Among two dozen suggested organic and inorganic curing agents for the binder, glyoxal and calcium chloride are disclosed. No suggestion of utility for inkjet recording is provided.

Suzuki, et al., in U.S. Pat. No. 6,238,047, disclose an inkjet receiver for pigment ink comprising a substrate, a layer of alumina hydrate and an upper layer of water-soluble polymer of approximately 0.01 to 50 g/m$^2$. Sharmin, et al., in US application 2004/0241351, disclose an inkjet receiver with a porous layer adjacent a support, and above the porous layer, a swellable layer comprising a hydrophilic polymer of about 0.5 to 5 g/m$^2$.

Tanaka, et al., in U.S. Pat. No. 7,199,182, disclose an inkjet recording material comprising an impervious substrate coated with at least 20 g/m$^2$ of an aqueous resin composition comprising a water soluble magnesium salt, an aqueous polyurethane, and one or more of a cationic compound (such as a cationic polymer), a nonionic water soluble high molecular weight compound (such as acetoacetylated poly(vinyl alcohol) (PVA acac)), and a water soluble epoxy compound.

SUMMARY OF THE INVENTION

It is a primary objective of one embodiment of this invention to enable the printing at high speed using aqueous inkjet inks, of glossy, semi-glossy and matte coated lithographic offset papers with high image quality, high optical density, and good physical durability, including resistance to wet or dry abrasion, water-fastness, and resistance to smearing from subsequent highlighter marking.

Briefly summarized, according to one aspect, the present invention provides an inkjet receiving medium comprising a substrate and having a topmost layer coated thereon at solid content of from 0.1 to 25 g/m$^2$, wherein the topmost layer comprises from 30-70 wt % of one or more aqueous soluble salts of multivalent metal cations and at least 0.05 g/m$^2$ of a cross-linked hydrophilic polymer binder. Improved optical density, reduced mottle and improved wet abrasion resistance are provided when the receiver is printed with an aqueous pigment-based ink. In further embodiments, the topmost layer may further comprise a latex dispersion for improved image durability.

Another aspect of the present invention is directed to a method of printing in which the above-described inkjet receiving medium is printed with an inkjet printer employing at least one pigment-based colorant in an aqueous ink composition.

In a further embodiment, the present invention provides a printing method comprising transporting an inkjet receiving medium of the invention by a continuous inkjet printhead applying an inkjet ink onto the receiving medium comprising at least one pigment based colorant in an aqueous ink composition, and subsequently transporting the printed receiving medium through a drying station.

Advantages of various embodiments of the invention include: high printed image quality including high pigment density and color gamut, and low grain and mottle; improved print durability to dry rub, wet abrasion, and highlighter marking; ability to provide all surface types including glossy, semi-glossy, and dull matte; and extremely low coverage allowing easy application and low cost.

DETAILED DESCRIPTION OF THE INVENTION

Inkjet receiving media in accordance with the invention comprise a substrate and have a preferably continuous topmost layer coated thereon at solid content of from 0.1 to 25 g/m$^2$, wherein the topmost layer comprises from 30-70 wt % of one or more aqueous soluble salts of multivalent metal cations and at least 0.05 g/m$^2$ of a cross-linked hydrophilic polymer binder. While the topmost layer of the receiving medium of the invention is believed to improve the inkjet printing performance on a wide variety of substrates, in a particular embodiment of the invention the substrate is one of a glossy, semi-glossy or matte coated lithographic offset paper. While such coated offset papers are designed for printing primarily with non-aqueous solvent-based inks, providing a topmost layer in accordance with the present invention over such coated offset papers has been found to enable inkjet printing with high image quality including reduced mottle, high optical density, and good physical durability, including resistance to wet or dry abrasion, water-fastness, and resistance to smearing from subsequent highlighter marking. Such embodiment employing a coated offset paper as the substrate of the inkjet receiving medium of the invention thus enables advantageous inkjet receiving mediums manufactured taking advantage of economies of scale in preparation of the medium substrate.

Lithographic coated offset papers typically comprise a paper base which has been coated with clay or the like and undergone surface calendering treatment to provide a desired surface smoothness. The invention applies to the use of both glossy and matte coated offset papers. Advantageously, the relatively low coating weights of the topmost layer of the inkjet receiving medium of the invention helps maintain the relative glossy or matte surface of the employed substrate. Such coated offset papers employable as the substrate of the inkjet receiving medium of the invention may be obtained from various commercial paper manufacturers, including, e.g., International Paper, Sappi, New Page, Appleton Coated, Abitibi-Bowater, Mohawk Papers, Verso, Mitsubishi, Norpac, Domtar, and many others. Specific examples include, e.g., STERLING ULTRA GLOSS paper (80 lb basis weight), a coated glossy offset paper for lithographic printing manufactured by NewPage, and UTOPIA BOOK (45 lb. basis weight), available from Appleton Coated, a coated matte offset paper.

In various embodiments, the substrate can be readily hydrophilic and capable of adsorbing and transferring ink colorant to the substrate interior prior to being coated thereon with the topmost layer of the invention, such as wherein the substrate may be porous. Alternatively, the substrate can be substantially impermeable to water or aqueous ink, such as a non-porous plastic film. In a particular preferred embodiment, the invention is particularly useful wherein the substrate comprises a relatively hydrophobic coated surface prior to being coated thereon with the topmost layer, and the topmost layer provides a continuous relatively hydrophilic surface.

While the invention is in certain embodiments directed towards the use of coated offset papers as the substrate, the topmost layer of the invention may also be used in combination with uncoated offset paper or other plain papers. Further, the invention may also be used with any of those supports usually used for inkjet receivers, such as resin-coated paper, polyesters, or macroporous materials such as polyethylene polymer-containing material sold by PPG Industries, Inc., Pittsburgh, Pa. under the trade name of TESLIN, TYVEK synthetic paper (DuPont Corp.), and OPPALYTE films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates.

Biaxially oriented support laminates are described in U.S. Pat. Nos. 5,853,965, 5,866,282, 5,874,205, 5,888,643, 5,888,681, 5,888,683, and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The kind of paper supports listed above include a broad range of papers, from high end papers, such as photographic paper to low end papers, such as the kind used for newsprint. In a preferred embodiment, commercial offset-grade coated paper is used.

The topmost coating composition may be applied to both sides of the substrate, or alternatively to only one side. The method employed to accomplish this can be selected from a number of known techniques, including but not limited to spraying, rod coating, blade coating, gravure coating (direct, reverse, and offset), flexographic coating, size press (puddle and metered), extrusion hopper coating, and curtain-coating. After drying, the resulting topmost layer can be calendered to improve gloss.

In one embodiment, in which paper is used as the support, the topmost layer can be applied in line as part of the paper manufacturing process. In another embodiment, the topmost layer may be coated as a separate coating step subsequent to the paper (or other substrate) manufacture. In a particular embodiment, the topmost layer may be applied inline as part of the inkjet printing operation, wherein such layer is applied to a substrate in a pre-coating station prior to printing of inkjet inks. Such inline application may be performed by the various coating processes identified above, or alternatively by a printhead positioned inline with the ink-applying printheads. When a printhead is used to apply the coating solution, the option exists of covering only the printed image area with the coating material, rather than the entire area of the substrate. Pre-coat application provides the advantage of eliminating color-to-color bleed during imaging, since the colorants of the ink are fixed instantaneously as the ink contacts the pre-coated substrate. Furthermore, with pre-coating, images appear darker and have sharper edge definition, since the coating minimizes ink penetration and allows more fixed colorant on the surface. Finally, while the pre-coat material may optionally be dried completely before image printing, complete drying of the pre-coated substrate may not be necessary. Therefore, drying can alternatively be applied once after imaging, resulting in considerable savings in energy.

The topmost layer of the inkjet receiving medium of the invention includes a water-soluble salt of a multivalent metal. Water-soluble is herein defined as at least 0.5 g of the salt capable of dissolving in 100 ml water at 20° C. The salt is preferably essentially colorless and non-reactive. More preferably, the multivalent metal is a cation selected from $Mg^{+2}$, $Ca^{+2}$, $Ba^{+2}$, $Zn^{+2}$, and $Ar^{+3}$, most preferably $Ca^{+2}$ or $Mg^{+2}$ in combination with suitable counter ions.

Examples of the salt used in the invention include (but are not limited to) calcium chloride, calcium acetate, calcium nitrate, magnesium chloride, magnesium acetate, magnesium nitrate, barium chloride, barium nitrate, zinc chloride, zinc nitrate, aluminum chloride, aluminum hydroxychloride, and aluminum nitrate. Similar salts will be appreciated by the skilled artisan. Particularly preferred salts are $CaCl_2$, $Ca(CH_3CO_2)_2$, $MgCl_2$, $Mg(CH_3CO_2)_2$, $Ca(NO_3)_2$, or $Mg(NO_3)_2$, including hydrated versions of these salts. Combinations of the salts described above may also be used. The topmost layer preferably comprises calcium ion equivalent to at least 0.05 g/m$^2$ of calcium chloride, more preferably equivalent to at least 0.1 g/m$^2$ of calcium chloride.

The topmost layer of the receiving medium of the invention further includes a cross-linked hydrophilic polymer binder alone or in combination with one or more additional binders. Such hydrophilic polymer binder comprises a polymer capable of adsorbing water, and preferably is capable of forming a continuous phase solution. Non-exclusive examples of such materials include gelatin, starch, hydroxycelluloses, polyvinyl alcohol, polyvinyl pyrrolidone, polyethylene imine, polyvinyl amine, and derivatives of these materials. A preferred binder is Gohsefimer Z-320 from Nippon Gohsei, an acetylacetate-modified polyvinyl alcohol.

The water-adsorbing hydrophilic polymer in the topmost layer coating formulation of the invention is crosslinked to improve the print resistance to abrasion while wet, as well as provide increased cohesiveness of the coating upon drying. To provide desired abrasion resistance and cohesiveness, the topmost layer comprises at least 0.05 g/m$^2$ of cross-linked hydrophilic polymer binder. The identity and amount of crosslinker will depend on the choice of polymer and its reactivity with the crosslinker, the number of cross-linking sites available, compatibility with other solution components, and manufacturing constraints such as solution pot life and coating drying speed. Non-exclusive examples of crosslinker materials are glyoxal, Cartabond TSI (Clariant), Cartabond EPI (Clariant), Sequarez 755 (Omnova), glutaraldehyde sodium bisulfate complex (Aldrich), Sunrez 700M (Omnova), Sunrez 700C (Omnova), CR-5L (Esprix), bis(vinyl) sulfone, bis(vinyl) sulfone methyl ether, adipoyl dihydrazide, epichlorohydrin polyamide resins and urea-formaldehyde resins. In a particular embodiment, the cross-linked hydrophilic polymer comprises a cross-linked aceto-acetylated polyvinyl alcohol polymer, such as aceto-acetylated polyvinyl alcohol polymer cross-linked with a glyoxal compound.

In accordance with the invention, the topmost layer is coated on the substrate at solid content of from 0.1 to 25 g/m$^2$, preferably from 0.1 to 12 g/m$^2$, more preferably from 0.2 to 8 g/m$^2$, more preferably from 0.2 to 3 g/m$^2$, more preferably from 0.25 to 2 g/m$^2$, and most preferably from 0.3 to 1.5 g/m$^2$, and such layer comprises from 30-70 wt % of one or more aqueous soluble salts of multivalent metal cations. Such combination of relatively low total solid laydown and relatively high multivalent metal salt concentration in a topmost coating composition, along with use of a cross-linked hydrophilic binder, has been found to surprisingly enable improved inkjet printing performance when printing pigment-based aqueous inks on a variety of substrates, including coated offset papers as discussed above.

While use of a multivalent metal salt and hydrophilic cross-linked polymeric binder in a topmost layer in accordance with the above specifications itself has been found to provide advantageous performance, in further embodiments, the topmost layer may further comprise a polymer latex filler such as polyurethane latex, vinylacetate-ethylene copolymer latex, and styrene-acrylic latex polymer dispersions for improved water resistance and image durability. Suitable polyurethanes, e.g., include those described in Tanaka et al. U.S. Pat. No. 7,199,182, the disclosures of which is incorporated by reference herein in its entirety. When present, however, the fraction of additional latex filler preferably does not exceed 75% of the total polymer in the topmost layer, to avoid undesired decrease in maximum density and increase in mottle upon printing with pigment-based inkjet inks. In a particular embodiment, polyurethane or other polymer latexes comprising anionic groups may be employed in combination with a polyamide/epichlorohydrin resin, to improve stability of the polymer dispersion in the presence of other cationic compounds as disclosed in U.S. Pat. No. 7,199,182.

The topmost layer coating formulation may further comprise additional optional components, such as inorganic or organic particles, as long as the coating solid laydown and relative concentration requirements of the invention are met. These can include, but are not limited to, kaolin clay, montmorillonite clay, delaminated kaolin clay, calcium carbonate, calcined clay, silica gel, fumed silica, colloidal silica, talc, wollastinite, fumed alumina, colloidal alumina, titanium dioxide, zeolites, or organic polymeric particles such as Dow HS3000NA.

Another aspect of the invention is directed to a method of printing in which the above-described receiver is printed with an inkjet printer employing at least one pigment-based colorant in an aqueous ink composition. Preferably, the pigment-based colorants are stabilized using anionic dispersants. Such dispersants can be polymeric, containing repeating sub-units, or may be monomeric in nature. The present invention is particularly advantageous for printing periodicals, newspapers, magazines, and the like. The printing method may employ a continuous high-speed commercial inkjet printer, for example, in which the printer applies colored images from at least two different print heads, preferably full-width printheads with respect to the media, in sequence in which the different colored parts of the images are registered.

One type of printing technology, commonly referred to as "continuous stream" or "continuous" inkjet printing, uses a pressurized ink source that produces a continuous stream of ink droplets. Conventional continuous inkjet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink-capturing mechanism (catcher, interceptor, gutter, etc.) and either recycled or disposed of. When print is desired, the ink droplets are not deflected and allowed to strike a print medium. Alternatively, deflected ink droplets may be allowed to strike the print media, while non-deflected ink droplets are collected in the ink capturing mechanism.

Typically, continuous inkjet printing devices are faster than droplet on demand devices and produce higher quality printed images and graphics. However, each color printed requires an individual droplet formation, deflection, and capturing system. Such continuous inkjet printing devices employ a high-speed inkjet receiving medium transport system capable of transporting at least one of roll-fed or sheet fed receiving medium, in combination with a continuous inkjet printhead for image-wise printing of inkjet ink onto the receiving medium and a drying station for drying of the printed image. Use of a topmost layer in accordance with the present invention in such a high speed continuous inkjet printing device advantageously enables an aqueous pigment-based printed inkjet image to be initially stabilized upon the surface of the receiving medium until the printed image can be dried in the device drying station to result in improved image quality, especially when printing on substrates comprising relatively hydrophobic coated offset papers or aqueous ink impermeable plastic films.

Examples of conventional continuous inkjet printers include U.S. Pat. No. 1,941,001 issued to Hansell on Dec. 26, 1933; U.S. Pat. No. 3,373,437 issued to Sweet et al. on Mar. 12, 1968; U.S. Pat. No. 3,416,153 issued to Hertz et al. on Oct. 6, 1963; U.S. Pat. No. 3,878,519 issued to Eaton on Apr. 15, 1975; and U.S. Pat. No. 4,346,387 issued to Hertz on Aug. 24, 1982.

A more recent development in continuous stream inkjet printing technology is disclosed in U.S. Pat. No. 6,554,410 to Jeanmaire, et al. The apparatus includes an ink-drop-forming mechanism operable to selectively create a stream of ink droplets having a plurality of volumes. Additionally, a droplet deflector having a gas source is positioned at an angle with respect to the stream of ink droplets and is operable to interact with the stream of droplets in order to separate droplets having one volume from ink droplets having other volumes. One stream of ink droplets is directed to strike a print medium and the other is directed to an ink catcher mechanism.

The colorant systems of the ink jet ink compositions employed in accordance with one embodiment of the invention may be dye-based, pigment-based or combinations of dye and pigment. Compositions incorporating pigment are particularly useful. Pigment-based ink compositions are used because such inks render printed images having higher optical densities and better resistance to light and ozone as compared to printed images made from other types of colorants. A wide variety of organic and inorganic pigments, alone or in combination with additional pigments or dyes, can be in the present invention. Pigments that may be used in the invention include those disclosed in, for example, U.S. Pat. Nos. 5,026,427; 5,086,698; 5,141,556; 5,160,370; and 5,169,436. The exact choice of pigments will depend upon the specific application and performance requirements such as color reproduction and image stability.

Pigments suitable for use in the invention include, but are not limited to, azo pigments, monoazo pigments, di-azo pigments, azo pigment lakes, β-Naphthol pigments, Naphthol AS pigments, benzimidazolone pigments, di-azo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black. In accordance with one embodiment of the invention, colorants comprising cyan, magenta, or yellow pigments are specifically employed. The pigment particles useful in the invention may have any particle sizes which can be jetted through a print head. Preferably, the pigment particles have a mean particle size of less than about 0.5 micron, more preferably less than about 0.2 micron.

Self-dispersing pigments that are dispersible without the use of a dispersant or surfactant can be used in the invention. Pigments of this type are those that have been subjected to a surface treatment such as oxidation/reduction, acid/base treatment, or functionalization through coupling chemistry. The surface treatment can render the surface of the pigment with anionic, cationic or non-ionic groups such that a separate dispersant is not necessary. The preparation and use of covalently functionalized self-dispersed pigments suitable for inkjet printing are reported by Bergemann, et al., in U.S. Pat. No. 6,758,891 B2 and U.S. Pat. No. 6,660,075 B2, Belmont in U.S. Pat. No. 5,554,739, Adams and Belmont in U.S. Pat. No. 5,707,432, Johnson and Belmont in U.S. Pat. Nos. 5,803,959 and 5,922,118, Johnson et al in and U.S. Pat. No. 5,837,045, Yu et al in U.S. Pat. No. 6,494,943 B1, and in published applications WO 96/18695, WO 96/18696, WO 96/18689, WO 99/51690, WO 00/05313, and WO 01/51566, Osumi et al., in U.S. Pat. No. 6,280,513 B1 and U.S. Pat. No. 6,506,239 B1, Karl, et al., in U.S. Pat. No. 6,503,311 B1, Yeh, et al., in U.S. Pat. No. 6,852,156 B2, Ito et al., in U.S. Pat. No. 6,488,753 B1 and Momose et al., in EP 1,479,732 A1.

Pigment-based ink compositions employing non-self-dispersed pigments that are useful in the invention may be prepared by any method known in the art of inkjet printing. Dispersants suitable for use in the invention in preparing stable pigment dispersions include, but are not limited to, those commonly used in the art of inkjet printing. For aqueous pigment-based ink compositions, particularly useful dispersants include anionic surfactants such as sodium dodecylsulfate, or potassium or sodium oleylmethyltaurate as described in, for example, U.S. Pat. No. 5,679,138, U.S. Pat. No. 5,651,813 or U.S. Pat. No. 5,985,017.

Polymeric dispersants are also known and useful in aqueous pigment-based ink compositions. Polymeric dispersants include polymers such as homopolymers and copolymers; anionic, cationic or nonionic polymers; or random, block, branched or graft polymers. The copolymers are designed to act as dispersants for the pigment by virtue of the arrangement and proportions of hydrophobic and hydrophilic monomers. The pigment particles are colloidally stabilized by the dispersant and are referred to as a polymer dispersed pigment dispersion. Polymer stabilized pigment dispersions have the additional advantage of offering image durability once the inks are dried down on the ink receiver substrate.

Preferred copolymer dispersants are those where the hydrophilic monomer is selected from carboxylated monomers. Preferred polymeric dispersants are copolymers prepared from at least one hydrophilic monomer that is an acrylic acid or methacrylic acid monomer, or combinations thereof. Preferably, the hydrophilic monomer is methacrylic acid. Particularly useful polymeric pigment dispersants are further described in US 2006/0012654 A1 and US 2007/0043144 A1, the disclosures of which are incorporated herein by reference.

Inkjet inks printed onto inkjet receiving media in accordance with the invention may contain further addendum as is conventional in the inkjet printing art. Polymeric dispersed pigment-based aqueous inkjet ink formulations suitable for use in particular embodiments of the present invention include those described, e.g., in copending, commonly assigned U.S. Ser. Nos. 12/624,439, 12/624,444, 12/474,770, and 12/474,730, the disclosures of which are incorporated by reference herein in their entireties.

EXAMPLES

Print non-uniformity, hereinafter "mottle," is defined as a visually apparent variation in observed color density in a print area intended to be uniform. Coalescence, the unwanted merging of non-adsorbed drops at the receiver surface in severe cases resembles mottle in that large patches of non-uniform density are apparent. In cases of less severe coalescence, the defect takes on the character of fine "grainy" non-uniformity. For purposes of evaluation of the present experimental results, all non-uniformities, regardless of their source or relative size, were combined in the evaluation.

Example 1

Three coating compositions were prepared. Comparative coating composition 1 comprised an aqueous composition of Gohsefimer Z-320 polyvinyl alcohol (Z-320 PVAacac, Nippon Gohsei) and glyoxal (Cartabond GH, Clariant) in a dry weight ratio of 100:0.3. Comparative coating composition 2 comprised an aqueous solution of anhydrous calcium chloride. Inventive coating composition 3 comprised an aqueous composition of Z-320 PVAacac, anhydrous calcium chloride, and glyoxal in a dry weight ratio of 50:50:0.15 and was made up to 4.3% solids in water. The solution pH was adjusted to pH=4 with acetic acid prior to addition of glyoxal. The compositions were applied to coated paper supports by an extrusion hopper coating process and subsequently dried to give a dry laydown of approximately 1.1 $g/m^2$. Support S is Sterling Ultra gloss paper (80 lb basis weight), a coated glossy offset paper for lithographic printing manufactured by NewPage. Support U is Utopia Book (45 lb. basis weight), available from Appleton Coated, a coated matte offset paper for lithographic printing.

Samples of the coatings were printed with KODAK PROSPER polymeric dispersant dispersed pigment-based cyan and black aqueous inkjet inks in separate patterns of uniform patches of density varying from minimum to maximum using a continuous inkjet printer test bed. The prints were allowed to dry for 3 days at ambient conditions. Dry rub resistance was tested using a Sutherland rub tester to abrade a black patch at maximum ink laydown (Dmax) for 10 cycles at 4 kg using bond paper as the abrasive. Wet abrasion was tested by applying ~0.2 ml water to a printed black Dmax patch for 20 seconds before rubbing for 5 back-and-forth cycles with double layer of paper toweling weighted with a 100 g brass weight (24 mm diameter). The change in density of the tested print regions was measured using a Spectrolino densitometer (status T visual) as an indication of the print durability to these tests. On the same paper samples cyan prints were made of a stepped density target, consisting of 10 uniform patches from 10% to 100% ink fill in 10% increments. These print samples were characterized using a QEA PIASII handheld image analyzer. The density of maximum cyan ink levels was measured (status T densitometry with a 2 degree observer). Mottle of each step patch was measured in terms of CIE L* using a 412 um tile size per the procedure described in 15013660 and summed over all 10 density patches. Alternatively, the maximum L* mottle value measured was recorded. The results of the measurements are listed in Table 1.

TABLE 1

| Substrate | Coating | PVAacac | $CaCl_2$ | Dmax Cyan | Mottle | Dry Rub Loss (%) | Wet Abr Loss (%) |
|---|---|---|---|---|---|---|---|
| S | None | 0 | 0 | 1.38 | 2.7 | 3 | 27 |
| S | CC-1 | 0.54 | 0 | 1.50 | 1.6 | 7 | 19 |
| S | CC-2 | 0 | 0.54 | 1.71 | 2.5 | 8 | 37 |
| S | I-1 | 0.54 | 0.54 | 1.94 | 1.1 | −1 | 10 |

TABLE 1-continued

| Substrate | Coating | PVAacac | $CaCl_2$ | Dmax Cyan | Mottle | Dry Rub Loss (%) | Wet Abr Loss (%) |
|---|---|---|---|---|---|---|---|
| U | None | 0 | 0 | 1.04 | 1.4 | −2 | 9 |
| U | CC-1 | 0.54 | 0 | 1.04 | 3.1 | 2 | 3 |
| U | CC-2 | 0 | 0.54 | 1.16 | 2.3 | −5 | 9 |
| U | I-1 | 0.54 | 0.54 | 1.39 | 2.4 | 0 | 3 |

The results in Table 1 demonstrate that the combination of components in the inventive coating composition I-1 provides a super-additive improvement in optical density compared to the effect of the individual components alone on examples of papers including a water-resistant glossy coated offset paper and a highly absorbent matte coated offset paper. In addition, when the glossy coated paper is treated with a coating composition of the present invention, the mottle is reduced to a greater extent than would be expected by simply summing the effects of the individual components. Furthermore, while it appears that both PVAacac and $CaCl_2$ treatments alone result in a slight worsening of dry rub loss, the inventive combination does not. In addition, while the comparative coating composition comprising PVAacac alone shows a modest reduction in wet abrasion, and the comparative comprising $CaCl_2$ alone worsens wet abrasion, the inventive combination unexpectedly demonstrates a substantially improved reduction compared to either of the individual treatments.

Example 2

Coating compositions were prepared according to the formula of inventive coating composition example I-1 except the ratio of Z-320:calcium chloride:glyoxal was changed to 65:45:0.195. Further coating compositions were made in which varying portions of the hydrophilic Z-320 polymer were replaced by water-resistant polymers latexes. The latex polymers were LP-1 (Airflex110, Air Products, a neutral vinylacetate-ethylene copolymer latex), LP-2 (Duroset Elite Plus, Celanese, a cationic crosslinkable ethylene-vinyl acetate copolymer) and LP-3 (Raycat H1Q105, Specialty Polymers Inc., a cationic styrene-acrylic latex polymer). The coating compositions were prepared with the same total weight of polymer but varying ratios of PVAacac and latex polymer. Sterling Ultra Gloss text paper (NewPage) was coated with each of the compositions in turn and dried. Coated samples were printed and evaluated as in Example 1. The results are shown in Table 2.

TABLE 2

| Sample | Latex type | Fraction PVAacac | Fraction Latex polymer | Dmax (cyan) | Mottle |
|---|---|---|---|---|---|
| I-2 | None | 1.00 | 0 | 1.99 | 1.2 |
| 3 | LP-1 | 0.50 | 0.50 | 1.94 | 1.5 |
| 4 | LP-1 | 0.25 | 0.75 | 1.89 | 1.9 |
| 5 | LP-1 | 0.125 | 0.875 | 1.87 | 2.3 |
| 6 | LP-2 | 0.50 | 0.50 | 1.84 | 1.5 |
| 7 | LP-2 | 0.25 | 0.75 | 1.87 | 1.6 |
| 8 | LP-2 | 0.125 | 0.875 | 1.87 | 2.1 |
| 9 | LP-3 | 0.50 | 0.50 | 1.80 | 1.5 |
| 10 | LP-3 | 0.25 | 0.75 | 1.92 | 2.7 |
| 11 | LP-3 | 0.125 | 0.875 | 1.91 | 4.0 |

The results in Table 2 show that the substitution of a water-resistant polymer latex for the hydrophilic solution polymer in the coating composition of the invention provides a slightly lower printed optical density, and an increase in undesirable mottle as the relative portion of latex polymer is increased. An increase in the cyan L* mottle from 1.2 to approximately 1.5 in visually noticeable; a L* mottle value above 2.0 is objectionable. It is therefore preferable that no more than 75% of the hydrophilic solution polymer be substituted with a water-resistant latex.

Example 3

Coating compositions were prepared according to the formula of inventive coating composition example I-1 except that the hydrophilic polymer and the cross-linking compound were varied. A comparative coating composition CC-3 comprised Z-320 PVAacac and calcium chloride. Inventive composition I-12 was like CC-3 but comprised in addition a cross-linker DHD (2,3-dihydroxy-1,4-dioxane (Aldrich)). Comparative coating composition CC-4 comprised the hydrophilic binder acid-processed ossein gelatin (Kind & Knox Gelatin) and calcium chloride. Coating compositions I-13, I-14, and I-15 according to the present invention were formulated by adding in turn, the following cross-linking compounds to CC-4: Cartabond TSI (Clariant) at 2.5% by weight of polymer, DHD=2,3-dihydroxy-1,4-dioxane (Aldrich) at 0.1% weight of polymer and GBS=glutaraldehyde sodium bisulfite (Aldrich) at 10% weight of polymer. The above compositions were coated on Sterling Ultra gloss paper (NewPage) by hopper extrusion at a dry laydown of 0.54 $g/m^2$ for the polymer and 0.38 $g/m^2$ for calcium chloride and dried. Coated samples were printed as in Example 1 and the printed samples were evaluated as in Example 1. The results of the evaluations are shown in Table 3.

TABLE 3

| Sample | Coating Composition | Crosslinker | Dmax (black) | Wet Abr loss | Dmax (cyan) | Mottle (cyan) |
|---|---|---|---|---|---|---|
| 3a | None | None | 2.07 | 56 | 1.67 | 3.0 |
| 3b | CC-3 | None | 0.80* | 22 | 1.49* | 2.6 |
| 3c | I-12 | Yes | 1.76 | 6 | 2.19 | 1.0 |
| 3d | CC-4 | None | 1.89 | 40 | 1.61 | 1.7 |
| 3e | I-13 | Yes | 1.89 | 12 | 1.61 | 1.0 |
| 3f | I-14 | Yes | 1.89 | 4 | 1.59 | 1.5 |
| 3g | I-15 | Yes | 1.73 | 10 | 1.49 | 1.8 |

*coating cracked

The results shown in Table 3 demonstrate substantially improved resistance to wet abrasion when a cross-linker for the hydrophilic polymer is added to the coating composition. The coating made with formulation CC-3 also was less cohesive upon drying after printing, with severe cracking of the image causing decreased print density and increased mottle relative to sample I-12 (with crosslinker). Formulations I-13, I-14, and I-15 demonstrate that the improvement in wet abrasion resistance for an apo-gelatin coating is not limited to a single crosslinker type.

Example 4

A composition according to the present invention was prepared by combining commercially available dispersion Patelacol IJ-26 (Dai Nippon Inks and Chemicals, available from Esprix Technologies, based on analysis believed to include acetoacetyleated PVA, a polyurethane dispersion, a polyamide/epichlorohyrin resin and a 4.3 wt % magnesium chloride based on total solids), calcium chloride and surfactant DF-110L (Air products) in a dry weight ratio of 6.5/5.6/0.03. The composition was coated on Utopia Book paper (45 lb basis weight) at 300 m/min using a reverse gravure cylinder applicator and dried in a 12 m air impingement drier adjusted to give a paper surface exit temperature of 74 C and residual moisture of 2.8 to 3.3%. Dry coverage was measured gravimetrically to be 0.38-0.50 g/m2. The second side of the paper was coated in an analogous manner and the two-side coated roll was slit on an unwinder without any blocking. Samples of the resulting test rolls and the uncoated Utopia Book were printed with KODAK PROSPER pigment-based cyan and black aqueous inks on an inkjet test fixture and evaluated as in Example 1. The results are shown in Table 4.

TABLE 4

| Sample | Dmax (cyan) | Mottle (cyan) | Dmax (Black) | Dry Rub % Dmax Loss | Wet Abr % Dmax Loss |
|---|---|---|---|---|---|
| Uncoated | 1.05 | 1.3 | 1.07 | 3 | 19 |
| Coated | 1.57 | 1.2 | 1.55 | 1 | 33 |

The results shown in Table 4 demonstrate substantial gains in print optical density accompanied by a significant improvement in print uniformity (decreased maximum L* mottle). Dry rub resistance remained excellent.

Example 5

An inkjet receiver of the present invention was prepared according to Example 4 except that the substrate was Sterling Ultra gloss (80 lb basis weight) in a 1.1 m wide roll. The coating component ratio was adjusted to 3.7/4.3/0.02. The paper surface exit temperature was adjusted to 104 to 109 C. The dry coverage was measured gravimetrically to be 0.45 g/m$^2$. Samples were printed and evaluated as in Example 4 and the results are shown in Table 5.

TABLE 5

| Sample | Dmax (cyan) | Mottle (cyan) | Dmax (Black) | Dry Rub % Dmax Loss | Wet Abr % Dmax loss |
|---|---|---|---|---|---|
| Uncoated | 1.57 | 3.0 | 2.11 | −1 | 19 |
| Coated | 1.89 | 1.2 | 1.96 | 1 | 19 |

Note the increased cyan print density and greatly improved uniformity (decreased mottle). Print durability of the treated SUG sample is unchanged relative to the same print on untreated SUG paper.

Example 6

A series of coatings of Patelacol IJ26 were made on a polyethylene resin-coated paper (RC paper, sourced from Felix-Schoeller) and on a glossy coated offset paper (Sterling Ultra gloss 80# or SUG, sourced from New Page). The surface of the SUG paper is characterized by a porous topcoat of inorganic pigments. The surface of the RC paper is a smooth continuous film that is impervious to water. The dry laydown of the IJ26 resin was varied from 0.65 to 20 gsm. A similar set of coatings on SUG paper was made using a coating solution containing 50 parts U26 and 50 parts calcium chloride salt. The dry laydown was again varied from 0.65 to 20 gsm.

The coatings were printed with KODAK PROSPER pigment-based black and cyan inkjet inks. The reflection status T density of a 100% fill black patch was measured using a Gretag Spectrolino spectrophotometer. The cyan prints consisted of a series of patches with increasing percent ink fills (10-100% in 10% steps). Each step patch was measured with a QEA PIAS2 handheld image analyzer for cyan density (status T reflection) and CIE L* mottle (ISO13660, 411 um tile size). The maximum mottle value measured for the entire cyan print was taken as a measure of print uniformity. Wet abrasion resistance was measured as previously described. The results of these measurements are summarized in Table 6A below:

TABLE 6A

| coating | description | base | IJ26 (g/m$^2$) | $CaCl_2$ (g/m$^2$) | Maximum cyan density | maximum cyan L* mottle | Maximum black density | wet rub % Dmax loss |
|---|---|---|---|---|---|---|---|---|
| C-61 | comparison | RC-paper | 21.5 | 0.0 | 1.94 | 1.2 | 2.07 | 82% |
| C-62 | comparison | SUG | 21.5 | 0.0 | 1.97 | 1.4 | 2.03 | 32% |
| C-63 | comparison | SUG | 10.8 | 0.0 | 1.96 | 1.5 | 2.03 | 25% |
| C-64 | comparison | SUG | 5.4 | 0.0 | 1.96 | 1.6 | 1.94 | 6% |
| C-65 | comparison | SUG | 2.7 | 0.0 | 1.85 | 1.5 | 1.64 | 11% |
| C-66 | comparison | SUG | 1.3 | 0.0 | 1.57 | 1.5 | 1.57 | 56% |
| C-67 | comparison | SUG | 0.7 | 0.0 | 1.33 | 1.9 | 2.05 | 67% |
| I-68 | invention | SUG | 10.8 | 10.8 | 2.04 | 0.8 | 2.07 | 77% |
| I-69 | invention | SUG | 5.4 | 5.4 | 2.01 | 0.8 | 2.03 | 79% |
| I-70 | invention | SUG | 2.7 | 2.7 | 1.97 | 0.8 | 2.13 | 51% |
| I-71 | invention-preferred | SUG | 1.3 | 1.3 | 1.98 | 0.9 | 2.07 | 27% |
| I-72 | invention-preferred | SUG | 0.7 | 0.7 | 1.94 | 1.1 | 1.95 | 2% |

Coating C-61 is an example similar to those of U.S. Pat. No. 7,199,182, but coated on resin-coated paper instead of PET. The same formulation applied to SUG substrate (coating C-62) gives similar print densities. U.S. Pat. No. '182 additionally teaches that laydowns less than 20 g/m$^2$ of resin should cause the print brightness to deteriorate, and this is observed with lower laydowns on IJ26 on SUG substrate (coatings C-63 through C-67), particularly at laydowns less than 5 g/m$^2$ In contrast, a blend of IJ26 plus $CaCl_2$ salt coated on SUG substrate (I-68 through I-72) shows little or no change in print density with decreasing coating dry laydown. Not only do the inventive coatings give equal or superior print density relative to coatings containing only IJ26 resin, but the print uniformity is noticeably improved as demonstrated by the lower L* mottle of the inventive coatings. Furthermore, preferred laydowns of less than 3 $g/m^2$, and especially most preferred of less than 1.5 $g/m^2$ demonstrate superior wet rub resistance.

In addition, the IJ-26 and $CaCl_2$ blend of the current invention provides better image quality in some aqueous inkjet systems when the dry coverage is low compared to when higher dry coverages are applied. It has been discovered that even relatively low dry coverages of the topmost layer can cause printed image cracking and black patch image scuffing. The likely cause of this effect is excess swelling of the inkjet receptive layer on wetting by the aqueous pigmented inks followed by shrinkage on drying resulting in cracks and optical surface artifacts. In the very thin layer of the current invention, swelling may be better controlled by the less absorptive (and less swelled) coated layer.

To illustrate this advantage of the current invention, a dispersion of IJ-26 (Dianippon Ink Company), anhydrous calcium chloride, and defoamant DF-110L of the composition described in Example 4 was coated on 62" wide, 45# Utopia Book matte (UBM) paper and 35" wide Sterling Ultra Gloss (SUG) paper at 300 m/min using a reverse gravure cylinder applicator. The coatings were dried in a 12 m air impingement dryer adjusted to give a paper surface exit temperature of 165 degF and residual moisture of about 3-4%%. Dry coverage was determined gravimetrically. The coated paper samples were trimmed to 8.5×11" sheets and printed with a test pattern on a Kodak ESP-5 desktop inkjet printer (which employs CMYK pigmented aqueous inks). Printed image quality was assessed as a function of total dry coverage. Results are reported in Table 6B.

TABLE 6B

| Paper | Dry Coverage | Image Cracking | Black Patch Appearance |
|---|---|---|---|
| UBM | 0.43 gsm | None | Rich dark black |
| UBM | 0.7 gsm | None | Light, scuffed |
| UBM | 1.4 gsm | Secondary color cracks | Light, smoky |
| SUG | 0.29 gsm | None | Rich glossy black |
| SUG | 0.78 | None | Scuffed black |
| SUG | 1.4 gsm | Secondary color cracks | Scuffed black |

Therefore, the preferred low dry coverage of the current invention, which is less expensive, and easier to apply and dry, provide the required image quality, while heavier laydowns will be expected to actually harm performance.

Example 7

A solution containing 65 parts IJ-26 polyurethane dispersion (Dainippon Ink and Chemical), 55 parts calcium chloride salt (Dow), and 0.1% (w/w solution) Olin10G surfactant was made. The solution had 11.9% total solids content. It was applied to an unprinted sample of Tetra Pak packaging material using a #4 wound wire rod to create a coating of approximately 1.1 g/m2 dry laydown, and dried under an infrared heater for ~20 seconds. Tetra Pak packaging material has a multiple laminate construction, with polyethylene on the outermost surfaces, and is water impermeable. Samples of both the treated and untreated Tetra Pak were printed on a continuous inkjet printer test bed with KODAK PROSPER pigment-based cyan ink. The prints made on the untreated Tetra Pak had poor image quality, characterized by severe coalescence and nonuniform density, bleed, and "picture-framing" (a localized density concentration about the perimeter of a printed area). In contrast, the treated samples showed excellent print density, uniformity and resolution, with no picture-framing observed.

The invention has been described with reference to a preferred embodiment. However, it will be appreciated that variations and modifications can be effected by a person of ordinary skill in the art without departing from the scope of the invention.

The invention claimed is:

1. An inkjet receiving media comprising:

a substrate that is a glossy, semi-glossy, or matte-coated lithographic offset paper or polymeric film, which substrate that provides a hydrophobic surface that is substantially impermeable to water or aqueous ink, the inkjet receiving media further comprising a topmost layer that provides a continuous hydrophilic surface that is aqueous inkjet ink receptive and is coated on the substantially water or aqueous ink impermeable surface of the substrate at a solid content of from 0.2 to 3 $g/m^2$, wherein the topmost layer comprises from 30-70 wt % of one or more aqueous soluble salts of multivalent metal cations, at least 0.05 $g/m^2$ of a cross-linked hydrophilic polymer binder, and latex polymer filler in an amount that does not exceed 75% of the total polymer in the topmost layer.

2. The inkjet receiving media of claim 1, wherein the topmost layer comprises from 10-70 wt % of hydrophilic polymer binder.

3. The inkjet receiving media of claim 1, wherein the one or more multivalent metal salts comprise a calcium salt.

4. The inkjet receiving media of claim 3, wherein the topmost layer comprises calcium ion equivalent to at least 0.10 $g/m^2$ of calcium chloride.

5. The inkjet receiving media of claim 1, wherein the topmost layer is coated at a solid content of from 0.25 to 2 $g/m^2$.

6. The inkjet receiving media of claim 1, wherein the topmost layer is coated at a solid content of from 0.3 to 1.5 $g/m^2$.

7. The inkjet receiving media of claim 1, wherein the substrate is readily hydrophilic and capable of adsorbing and transferring ink colorant to the substrate interior prior to being coated thereon with the topmost layer.

8. The inkjet receiving media of claim 1, wherein the substrate is a glossy, semi-glossy, or matte-coated lithographic offset paper.

9. The inkjet receiving media of claim 1, wherein the substrate comprises a plastic film.

10. The inkjet receiving media of claim 1, wherein the cross-linked hydrophilic polymer comprises a cross-linked aceto-acetylated polyvinyl alcohol polymer.

11. The inkjet receiving media of claim 10, wherein the cross-linked hydrophilic polymer comprises an aceto-acetylated polyvinyl alcohol polymer cross-linked with a glyoxal compound.

12. The inkjet receiving media of claim 1, wherein the one or more multivalent metal salts comprises a cation selected from $Mg^{+2}$, $Ca^{+2}$, $Ba^{+2}$, $Zn^{+2}$, and $Al^{+3}$.

13. The inkjet receiving media of claim 1, wherein the one or more multivalent metal salts comprise $CaCl_2$, $Ca(CH_3CO_2)_2$, $MgCl_2$, $Mg(CH_3CO_2)_2$, $Ca(NO_3)_2$, or $Mg(NO_3)_2$, or hydrated versions of these salts.

14. A method of printing in which the inkjet receiving media of claim 1 is printed with an inkjet printer employing at least one pigment-based colorant in an aqueous ink composition wherein the pigment-based colorant is stabilized using anionic dispersants or is self-dispersed.

15. The method of claim 14, comprising transporting the inkjet receiving media by a continuous inkjet printhead applying the ink composition onto the receiving medium, and subsequently transporting the printed receiving medium through a drying station.

16. The printing method of claim 15 in which the inkjet printer is a continuous high-speed commercial inkjet printer and the inkjet printer applies colors from at least two different print heads in sequence in which different colored parts of an image printed on the inkjet-receiving medium are registered.

17. A method for preparing the inkjet receiving media of claim 1, the method comprising:

providing a substrate that is a glossy, semi-glossy, or matte-coated lithographic offset paper or polymeric film, which substrate provides a hydrophobic surface that is substantially impermeable to water or aqueous ink, applying a topmost coating composition to the substantially water or aqueous ink impermeable surface of the substrate to provide a topmost layer coating, the topmost coating composition comprising one or more aqueous soluble salts of multivalent metal cations, a cross-linked hydrophilic polymer binder, and a latex polymer filler, and drying the topmost layer coating to provide a topmost layer providing a continuous hydrophilic surface that is aqueous inkjet ink receptive, wherein the topmost layer solid content is from 0.2 to 3 $g/m^2$, and the topmost layer comprises from 30-70 weight % of the one or more aqueous soluble salts of multivalent metal cations, at least 0.05 $g/m^2$ of the cross-linked hydrophilic polymer binder, and the fraction of latex filler does not exceed 75% of the total polymer in the topmost layer.

* * * * *